US005781832A

United States Patent [19]

Inoue et al.

[11] Patent Number: 5,781,832

[45] Date of Patent: Jul. 14, 1998

[54] IMAGE FORMING APPARATUS IN WHICH RESIDUAL TONER IS RECOVERED BY DEVELOPING MEANS

[75] Inventors: Ryo Inoue, Musashino; Kenichiro Waki, Kawasaki; Hiroyuki Suzuki, Yokohama, all of Japan

[73] Assignee: Canon Kabushiki Kaisha, Japan

[21] Appl. No.: 850,863

[22] Filed: May 2, 1997

Related U.S. Application Data

[63] Continuation of Ser. No. 469,678, Jun. 6, 1995, abandoned.

[30] Foreign Application Priority Data

Jun. 7, 1994 [JP] Japan ..... 6-125508

[51] Int. Cl.[6] ..... G03G 15/06; G03G 21/00

[52] U.S. Cl. ..... 399/149; 399/285; 399/357

[58] Field of Search ..... 399/285, 357, 399/149, 150

[56] References Cited

U.S. PATENT DOCUMENTS 4,515,465 5/1985 Miyoshi et al. ..... 355/270

4,727,395 2/1988 Oda et al. ..... 355/270

4,769,676 9/1988 Mukai et al. ..... 355/270

*Primary Examiner*—R. L. Moses

*Attorney, Agent, or Firm*—Fitzpatrick, Cella, Harper & Scinto

[57] ABSTRACT

An image forming apparatus has an image bearing member, charging means for uniformly charging the image bearing member, electrostatic image forming means for forming an electrostatic image on the image bearing member charged by the charging means, developing means for developing the electrostatic image on the image bearing member with a toner and also recovering any residual toner on the image bearing member, and transferring means for transferring the toner image to a transfer member conveyed. Upon re-operation after jam, at least one full rotation of the image bearing member effects the recovery of the toner on the image bearing member by the developing means with the charging by the charging means being rendered OFF.

8 Claims, 9 Drawing Sheets

IMAGE FORMING APPARATUS IN WHICH RESIDUAL TONER IS RECOVERED BY DEVELOPING MEANS

This application is a continuation of application Ser. No. 08/469/678 filed Jun. 6, 1995, now abandoned.

BACKGROUND OF THE INVENTION

1. Field of the Invention

This invention relates to an image forming apparatus in which an electrostatic image on an image bearing member is developed with a toner, whereafter the toner image is transferred to a transfer medium, and particularly to an image forming apparatus in which any residual toner after image transfer is recovered by a developing device to thereby eliminate a cleaner.

2. Related Background Art

FIG. 2 of the accompanying drawings shows an example of an image forming apparatus.

An original G placed on an original supporting table 10 is scanned by a scanning unit 9.

A photosensitive drum 1 has its electricity removed by a pre-exposure lamp 2, and thereafter is uniformly charged by a charger 3.

This charged photosensitive drum is image-exposed by a laser scanning unit 100, whereby an electrostatic image is formed on the photosensitive drum.

This electrostatic image is developed with a toner by a developing device 4.

The toner image is transferred to a transfer medium by a transfer charger 8, and the transfer medium having had its electricity removed and separated from the photosensitive drum 1 by a separating and electricity removing device is fixated by a fixating device 6.

Any residual toner on the photosensitive drum 1 is removed by a cleaner 5.

In recent years, the downsizing of such an apparatus has progressed, but the downsizing of only the devices for charging, exposure, development, transfer, fixation and cleaning as previously described has limited the downsizing of the entire apparatus. Also, the aforementioned residual toner is recovered by the cleaner 5, but it is preferable from the viewpoint of environmental protection that such waste toner be absent.

So, a cleanerless apparatus in which the cleaner is eliminated and cleaning is effected concurrently with development by the developing device has also appeared. Cleaning concurrent with development is a method whereby some toner remaining on the photosensitive drum after transfer is recovered by a fog-removing bias during development after the next step.

According to this method, the residual toner is recovered for use after the next step, therefore, waste toner can be made null. Also, this method has a great advantage in terms of space and can lead to a great degree of downsizing.

However, in the cleanerless apparatus as described above, when the operation is interrupted by a cause such as paper jam during the developing or transfer step, a great deal of untransferred toner will remain residual.

If upon re-operation after the treatment of jam, charging is effected by the charger 3 to stabilize a charging potential on the photosensitive drum having a great deal of residual toner thereon, the amount of charge of the residual toner will increase.

The toner recovering efficiency during the cleaning concurrent with development depends much on the amount per unit area (M(mg)/S($cm^2$)) or the amount of charge of the residual toner on the photosensitive drum.

If the amount of charge of the toner increases, the electrostatic attraction of the toner to the photosensitive drum will increase and the recovery of the toner will become difficult.

SUMMARY OF THE INVENTION

It is an object of the present invention to provide an image forming apparatus in which contamination by residual toner is prevented from occurring upon re-operation after jam treatment.

It is another object of the present invention to provide an image forming apparatus in which any reduction in the toner recovering efficiency by a developing device after jam treatment is prevented.

It is still another object of the present invention to provide an image forming apparatus having:

an image bearing member;

charging means for uniformly charging said image bearing member;

electrostatic image forming means for forming an electrostatic image on said image bearing member charged by said charging means;

developing means for developing the electrostatic image on said image bearing member with a toner and also recovering any residual toner on said image bearing member; and transferring means for transferring the toner image to a transfer medium conveyed;

wherein upon re-operation after jam, at least one full rotation of said image bearing member effects the recovery of the toner on said image bearing member by said developing means with the charging by said charging means being rendered OFF.

Further objects of the present invention will become apparent from the following detailed description.

DESCRIPTION OF THE PREFERRED EMBODIMENTS

Recently, digitization in an image forming apparatuses such as copying apparatuses and printers has progressed with the tendency toward the full color and systematization thereof.

For example, apparatuses such as laser beam printers in which a laser beam is scanned and by the ON and OFF of this laser beam, a latent image is formed on a photosensitive drum to thereby record a desired image have become widely known. The typical use of such apparatuses is binary recording of characters, figures, etc. The recording of characters, figures, etc. does not require an intermediate tone and therefore, the structure of the printers can be simplified.

Now, there are printers which, in spite of being of such a binary recording type, can effect intermediate tone formation. Printers adopting the dither method, the density pattern method, and the like are well known as such printers. As is well known, however, high resolution is not obtained in the printers adopting the dither method, the density pattern method, etc. So, in recent years, there has been proposed a method of forming an intermediate tone pixel in each pixel without reducing high recording density. This is a method of modulating a laser beam with a pulse width (PWM) by an image signal to thereby effect intermediate tone formation, and according to this method, images of high resolution and high harmony can be formed.

Figure 1:
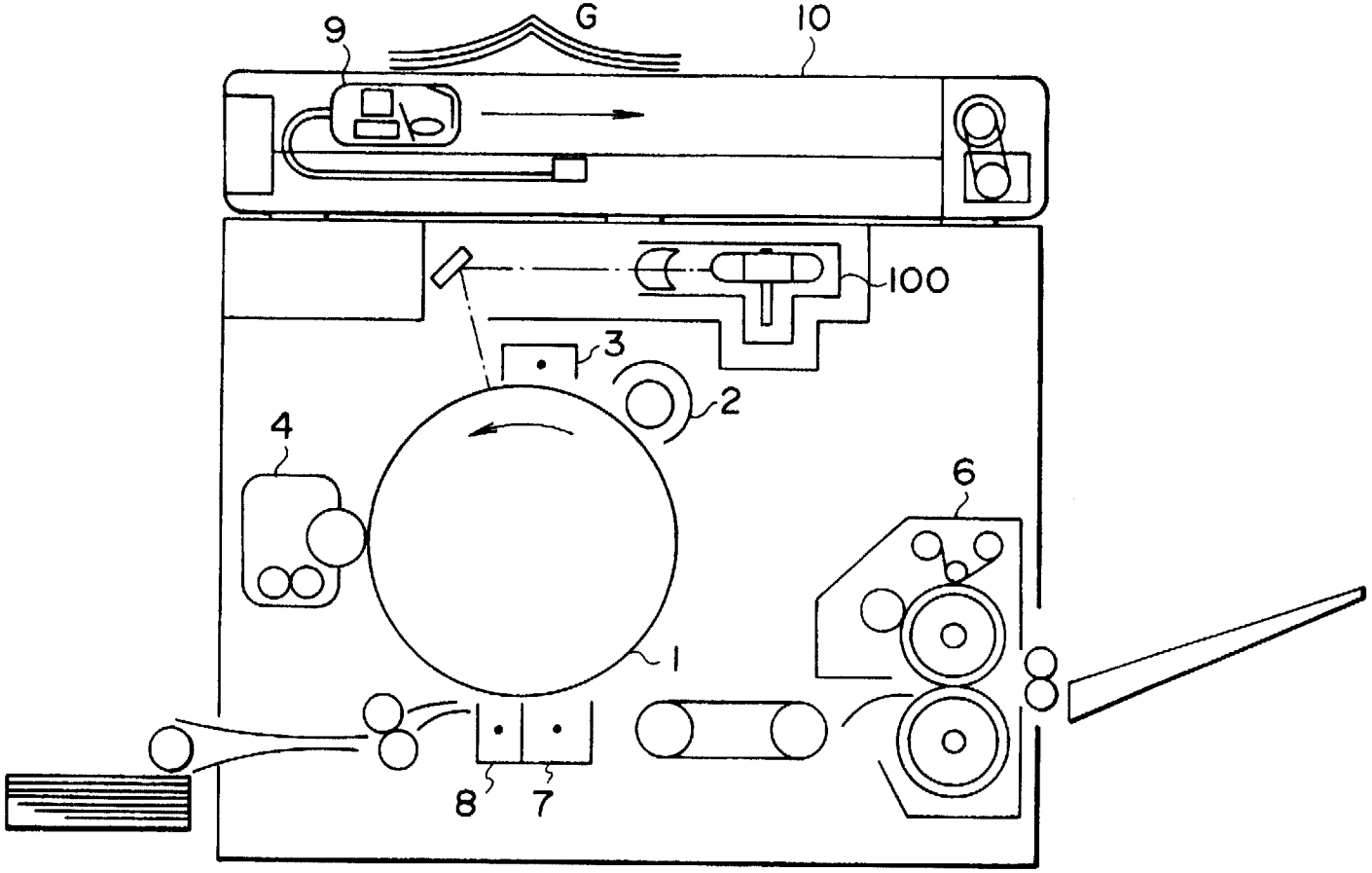
FIG. 1 is a cross-sectional view of an image forming apparatus according to an embodiment of the present invention.
Figure 2:
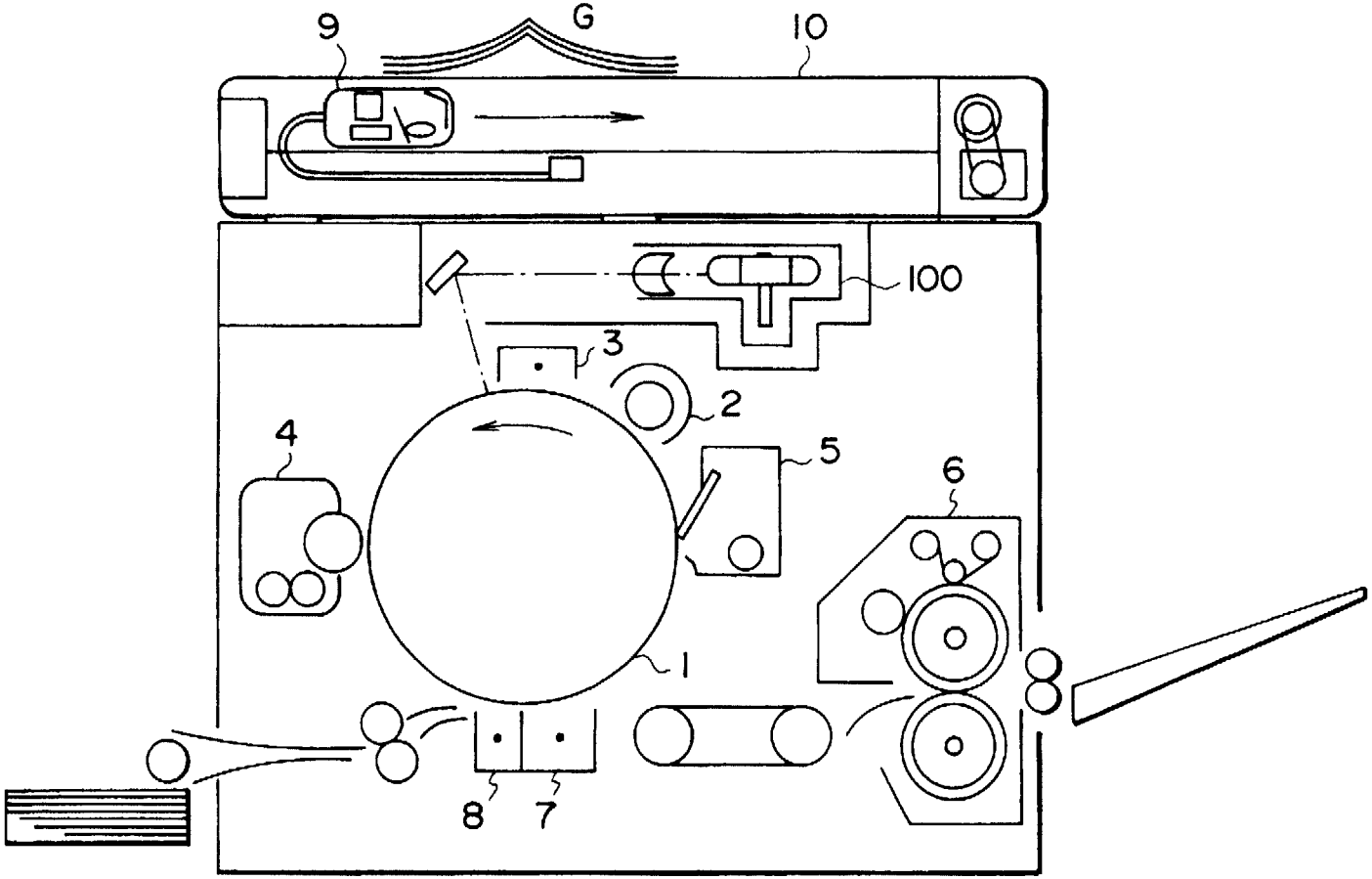
FIG. 2 is a cross-sectional view of an image forming apparatus which is the background of the present invention.

FIG. 1 is a cross-sectional view of an image forming apparatus of the digital copying type according to an embodiment of the present invention.

An original G is first set on an original supporting table 10 with the surface thereof to be copied facing downward. A copy button is then depressed to thereby start copying. An original irradiating lamp, a short-focus lens array and a CCD sensor as a unit 9 scan the original while irradiating the original, whereby the reflected light of the illuminating scanning light reflected by the surface of the original is imaged by the short-focus lens array and enters the CCD sensor. The CCD sensor is comprised of a light receiving portion, a transfer portion and an output portion. In the light receiving portion of the CCD sensor, a light signal is converted into an electrical signal, and by the transfer portion, the electrical signal is transferred to the output portion in synchronism with a clock pulse, and in the output portion, a charge signal is converted into a voltage signal, which in turn is amplified and outputted while being made into a low impedance. An analog signal obtained in this manner is subjected to well-known image processing and is converted into a digital signal and is sent to a printer unit. In the printer unit, the image signal is received and an electrostatic latent image is formed in the following manner. A photosensitive drum 1 is rotatively driven about a central support shaft at a predetermined peripheral velocity in the direction of arrow a, and in the rotation process thereof, is uniformly charged to the positive polarity or the negative polarity by a charger 3, and the light of a solid state laser element 102 (FIG. 3) turned on and off correspondingly to the image signal is scanned on the uniformly charged surface by a rotatable polygon mirror 104 rotated at a high speed, whereby electrostatic latent images corresponding to the images of the original are successively formed on the surface of the photosensitive drum 1.

Figure 3:
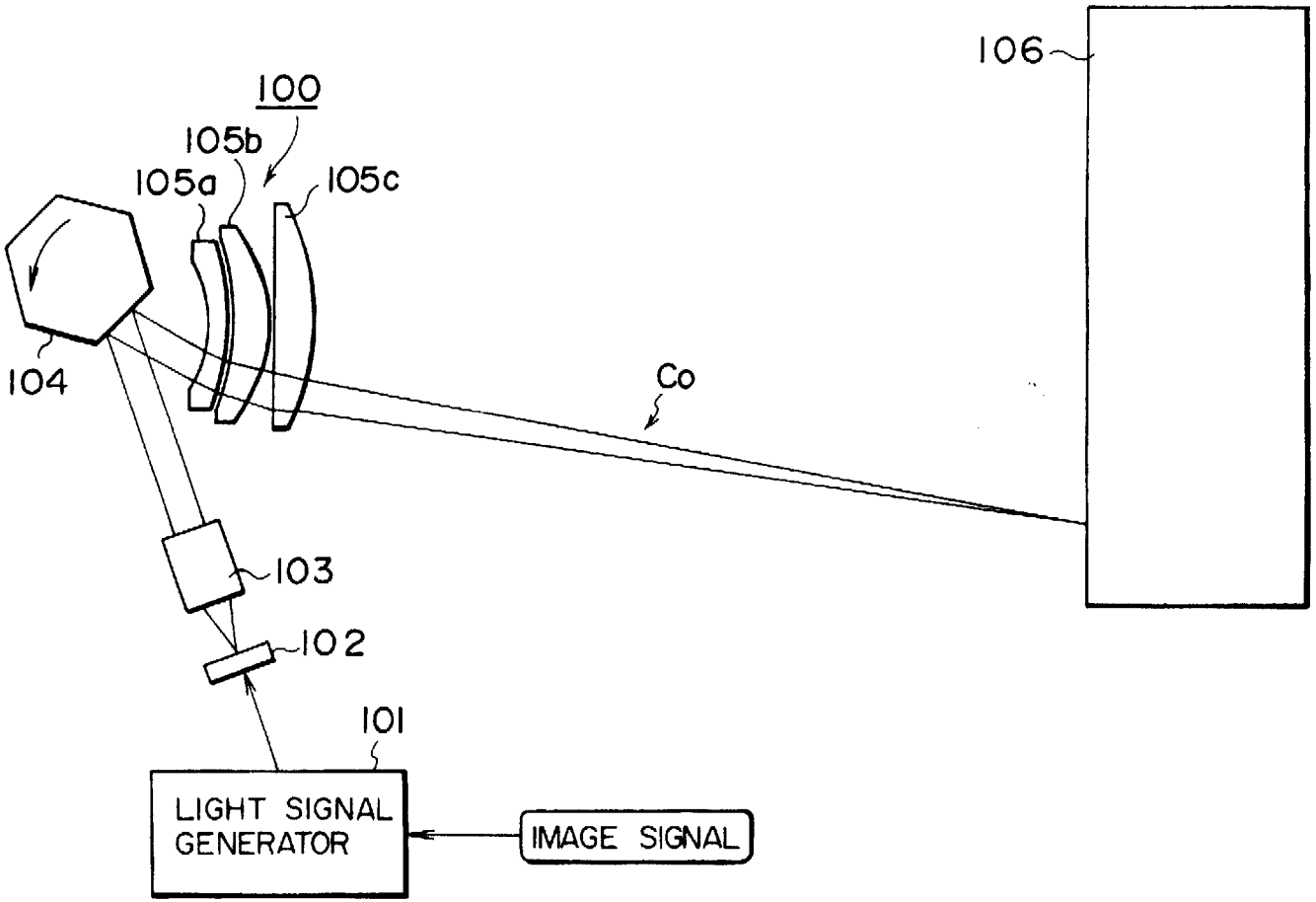
FIG. 3 is a schematic view showing a laser scanning unit.

FIG. 3 schematically shows the construction of a laser scanning unit 100 which scans a laser beam in the above-described apparatus. When the laser beam is to be scanned by this laser scanning unit 100, the solid state laser element 102 is first turned on and off at predetermined timing by a light signal generator 101 on the basis of the inputted image signal. The laser beam emitted from the solid state laser element 102 is converted into a substantially parallel beam of light by a collimator lens system 103 and further is scanned in the direction of arrow c by the rotatable polygon mirror 104 rotated in the direction of arrow b and is imaged in a spot-like shape on a scanned surface 106 such as the photosensitive drum by fθ lens units 105*a*, 105*b* and 105*c*. By the scanning of such a laser beam, an exposure distribution corresponding to one image scan is formed on the scanned surface 106 and further, if in each scan, the scanned surface 106 is scrolled by a predetermined amount perpendicularly to the scanning direction, an exposure distribution conforming to the image signal will be obtained on the scanned surface 106.

The photosensitive drum 1 as an image bearing member is charged to −600V by the primary charger 3 with minus corona imparted thereto. The laser beam corresponding to the image signal is applied to the photosensitive drum 1 and as regards the potential on that portion thereof to which the laser beam has been applied drops, whereby a latent image is formed on the photosensitive drum. A minus toner on that portion of the latent image to which the laser beam has been applied is reversed and developed by a developing device 4, and the developed toner is transferred to a transfer medium P by a transfer charger 8. The transferred toner is heat-fixated on the transfer medium by a fixating device 6.

Any residual toner which could not be transferred by a transfer charger 7 is carried on the drum and enters the next recording step. If this residual toner is intactly carried to the next transfer step, the toner on that portion of the photosensitive drum on which there is no recording signal will be transferred onto the transfer medium and will become an image stain, but in the developing step, a fog removing electric field for pulling the toner particles back toward the developing means is applied to a white ground portion, thus cleaning the image bearing member.

The developing step will now be described. Generally, the developing method is divided broadly into four kinds, i.e., a method of coating a sleeve with a non-magnetic toner by a blade or the like, and coating a photosensitive drum with a magnetic toner by a magnetic force and conveying the magnetic toner to thereby develop the magnetic toner in its non-contact state with the photosensitive drum (one-component non-contact development), a method of developing the toner coating the photosensitive drum in the above-described manner, in its contact state with the photosensitive drum (one-component contact development), a method of using a mixture of toner particles and a magnetic carrier as a developer and conveying it by a magnetic force to thereby develop it in its contact state with the photosensitive drum (two-component contact development), a method of developing the above-mentioned two-component contact developer in its non-contact state with the photosensitive drum (two-component non-contact development). The two-component contact developing method is often used from the viewpoints of the high image quality and high stability of images.

Figure 4:
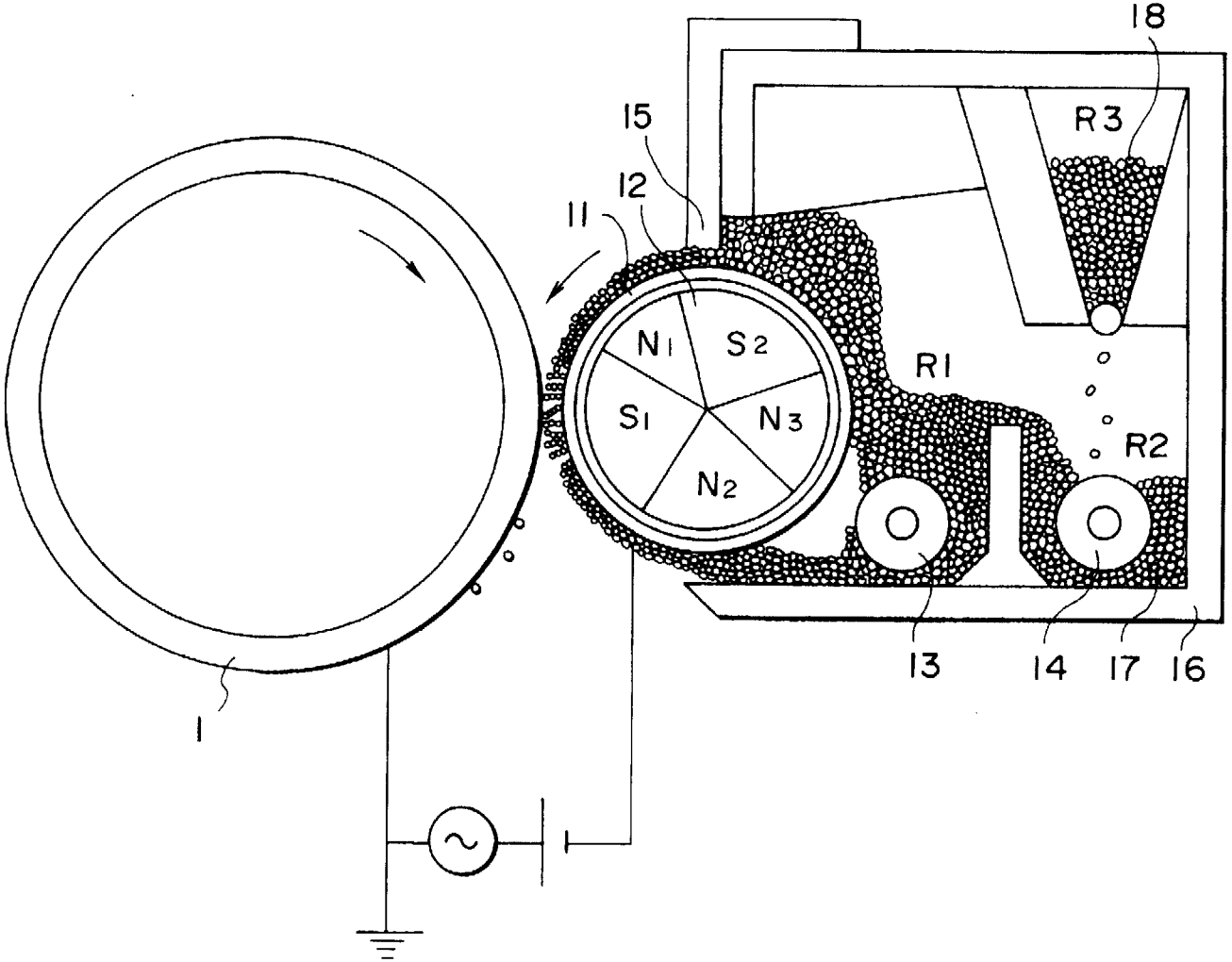
FIG. 4 is a schematic view showing a developing device.

FIG. 4 is a schematic view of the developing device 4 for two-component magnetic brush development. In FIG. 4, the reference numeral 11 designates a developing sleeve, the reference numeral 12 denotes a magnet roller fixedly disposed in the developing sleeve, the reference numerals 13 and 14 designate agitating screws, the reference numeral 15 denotes a regulating blade disposed to form the developer as a thin layer on the surface of the developing sleeve, and the reference numeral 16 designates a developing container. A description will hereinafter be made of the developing step of visualizing the electrostatic latent image by a two-component magnetic brush method by the use of the above-described developing device, and a circulation system for the developer. The developer first drawn up by a pole $N_3$ with the rotation of the developing sleeve 11 is regulated by the regulating blade 15 disposed perpendicularly to the developing sleeve 11 in the process of being conveyed from a pole $N_2$ to a pole $N_1$, and is formed as a thin layer on the developing sleeve 11. When the developer formed as a thin layer is conveyed to a developing main pole $S_1$, magnetic brush is formed by a magnetic force. The electrostatic latent image is developed by the developer formed in the shape of ears, whereafter the developer on the developing sleeve 11 is returned into the developing container 16 by the repulsing magnetic fields of the poles $N_3$ and $N_2$.

The residual toner on the photosensitive drum 1 is conveyed to the developing portion while remaining on the drum. The sleeve 11 including the fixed magnet roller 12 therein is provided in the developing device, and the sleeve is coated with the developer in the developing container 4 in the form of a thin layer by the blade 15 and the developer is conveyed to the developing portion. The developer is a two-component developer consisting of 8 μm toner of minus charging property and 50 μm magnetic carrier mixed together at toner density 5% by weight. The toner used in the present embodiment is a toner manufactured by the polymerizing method, and is spherical in shape and much better in fluidity than a toner made by the crushing method which is usually used in a machine of this kind. The toner density is controlled by an optical type toner density sensor, not shown, and the toner in a toner hopper R3 is supplied by a supply roller. The developer in the container is uniformly agitated by the agitators 13 and 14. An AC+DC voltage of 2 $kV_{pp}$, 2 kHz, Vdc=−450V is applied from a voltage source, not shown, to the sleeve. The developer coating the sleeve in the form of a thin layer and conveyed to the developing portion contributes to development on the photosensitive drum 1 by an electric field provided by the AC voltage.

The toner to be removed by such cleaning concurrent with development is a small amount of residual toner of which M/S is 0.2 or less. However, when the operation is stopped as by paper jam in the developing or transferring step, a great deal of toner of which M/S is greater than 0.2 may remain on the drum 1. If an attempt is made to recover this toner by way of the conventional re-operating step, the amount of charge of the toner will rise due to the charging process of the drum 1 in the potential control wherein charging is effected to stabilize the surface potential of the photosensitive drum, and the electrostatic attraction to the drum 1 will increase and thus, recovery will become difficult. The toner which cannot be completely recovered will appear as image stains on the image after re-operation. To prevent this, it is effective to provide the cleaning step omitting the charging step before the potential control.

Figure 5:
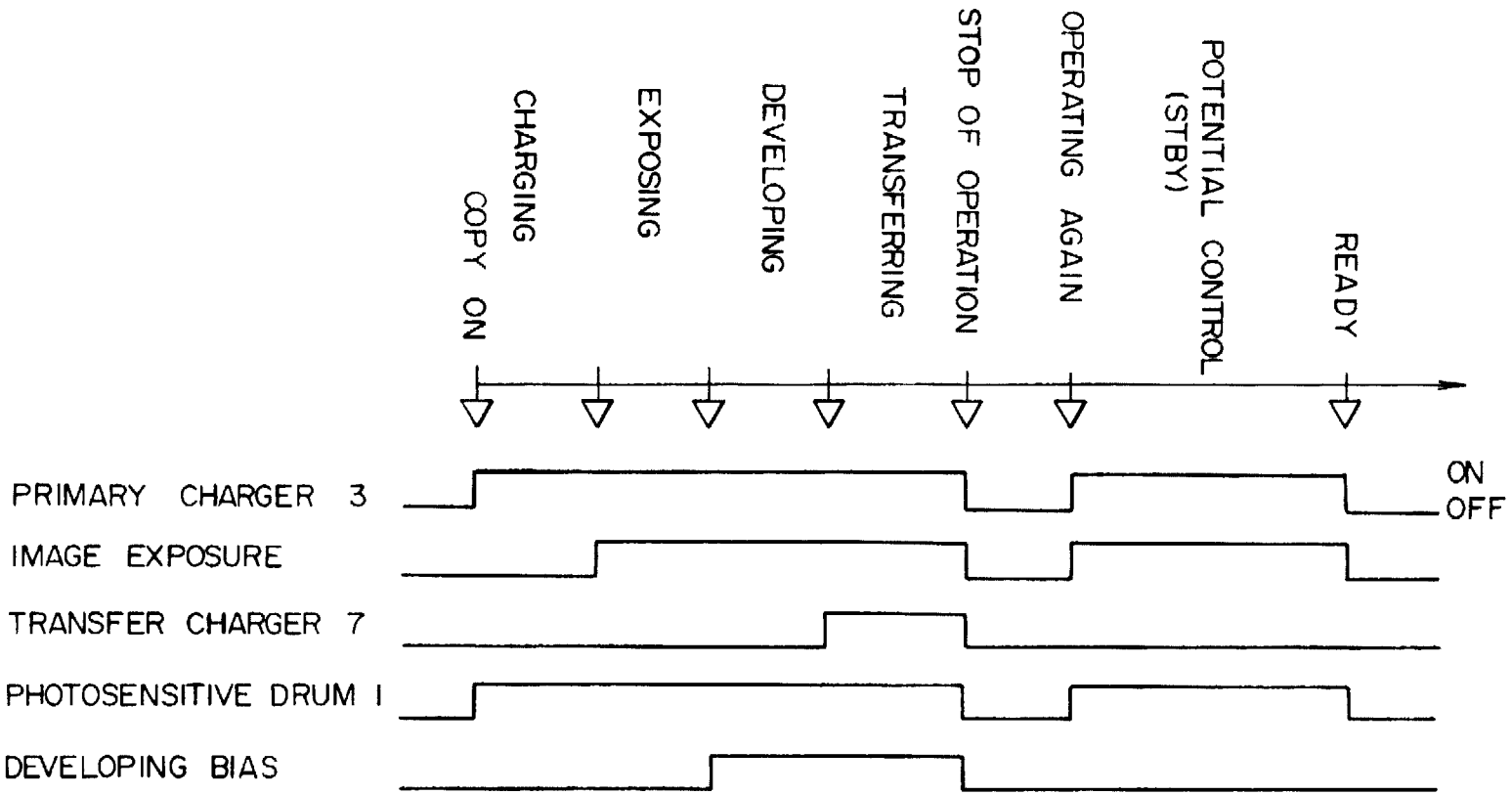
FIG. 5 shows a sequence used for the comparison of Embodiment 1 of the present invention.
Figure 6:
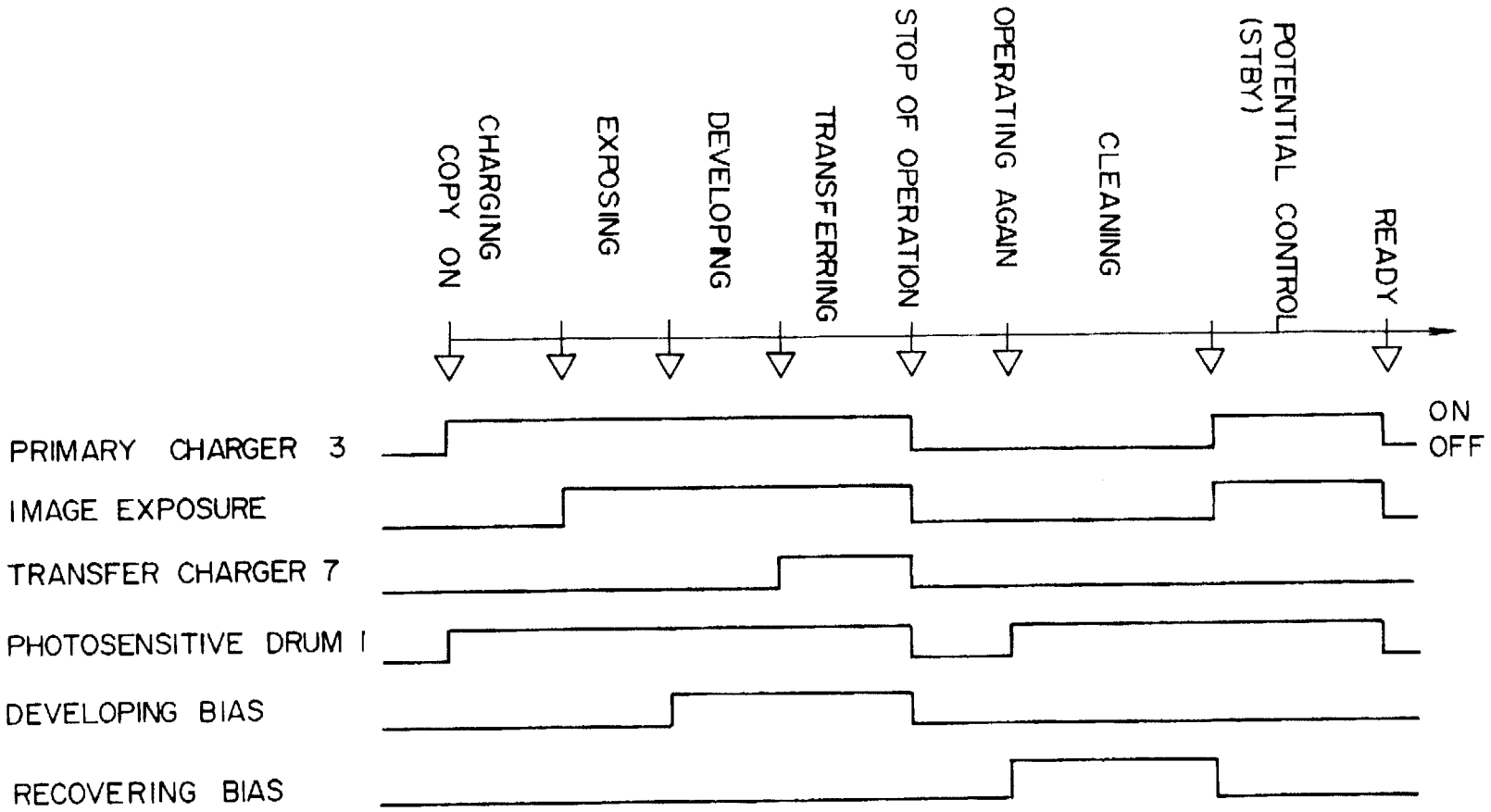
FIG. 6 shows a sequence used in Embodiment 1 of the present invention.

FIG. 5 shows the sequence of a comparative example from the start of copying to the stop of operation, re-operation and the end of standby. FIG. 6 shows the sequence in the present embodiment. In the sequence shown in FIG. 5, the drum is charged by the primary charger during the potential control after the re-operation and at this time, the amount of charge of the toner on the drum rises. As shown in FIG. 6, in the present embodiment, the cleaning step is provided before the potential control, whereby the rise of the amount of charge of the toner can be prevented. At this time, recovering bias which will be described later is applied to the developing sleeve 11. Also, during this time, the drum is caused to make at least one full rotation from its stopped position.

Figure 7:
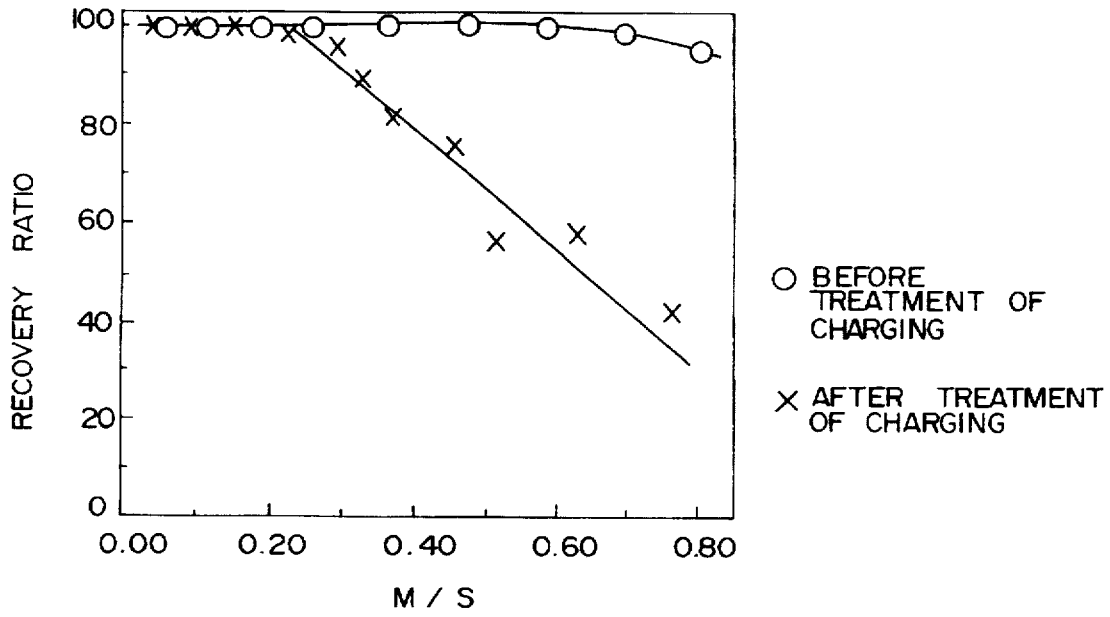
FIG. 7 is a graph showing the relation between M/S and recovery ratio used in Embodiment 1 of the present invention.

Description will now be specifically made of the influence the rise of the amount of charge of the toner has on the recovering efficiency. FIG. 7 shows the relation between M/S and the recovering efficiency on the drum in a polymerized toner of an amount of charge 20 μc/g before the charging process and a polymerized toner of an amount of charge 40 μc/g subjected to the charging process. An AC bias of $V_{pp}$=2000V and frequency 2 kHz and a DC bias of V=+200V are applied to the developing sleeve and the drum electrode is earthen. As can be seen from FIG. 7, when M/S is small as in the residual toner, the toner is recovered independently of the amount of charge, but when M/S becomes great, the toner having a great amount of charge becomes difficult to recover. This shows that to recover a great deal of toner remaining on the drum 1 during re-operation, it is effective to omit the charging step and effect cleaning concurrent with development.

The bias condition during the above-described toner recovery differs from that during image formation. The toner recovery by the cleaning concurrent with development is to recover the residual toner on the non-image portion by a fog-removing potential, but here the residual toner on the image portion must be recovered and therefore, it is necessary to give an electric field opposite to that during image formation. Therefore, in the cleaning step after re-operation, it is necessary to change the DC bias applied to the developing sleeve 11 to a value higher by 50 to 200V than the latent image potential of the image portion. However, it is not necessary to change the AC bias. It is to be understood that this bias during the cleaning is the recovering bias.

The untransferred toner on the image portion could be recovered by such a method.

(Embodiment 2)

Figure 8:
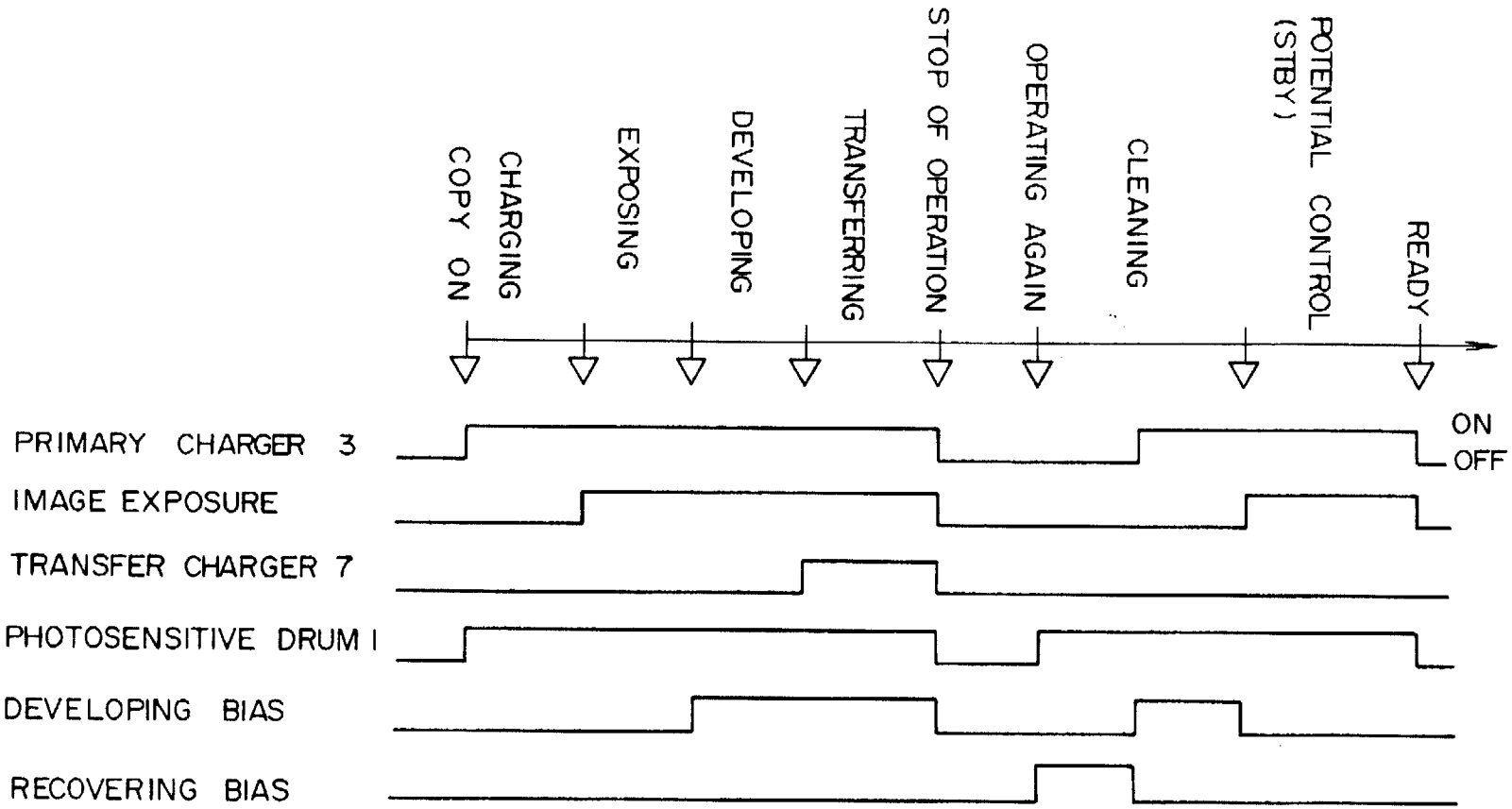
FIG. 8 shows a sequence used in Embodiment 2 of the present invention.

In Embodiment 1, when the operation is interrupted by a cause such as paper jam during the developing or transferring step and any residual toner is to be recovered, the charging step is omitted and the recovering bias is applied to the developing sleeve, but this is directed to a regular toner. In some cases, the toner contained in the developer somewhat contains a toner having charges of the opposite polarity, i.e., a reverse toner. When the reverse toner is contained in the untransferred toner, the reverse toner effects movement opposite to that of the regular toner with respect to an electric field and therefore, the reverse toner cannot be recovered by the method of Embodiment 1. To recover the reverse toner, the regular toner may be recovered by the method of Embodiment 1, whereafter the drum 1 may be charged by the primary charger 3, whereby the reverse toner on the drum 1 may be regularized, and then may be recovered. At this time, a developing bias is applied to the developing sleeve 11 and the untransferred toner is recovered by a fog-removing potential. The AC bias need not be changed. Also, in the meantime, the charging process is effected for at least one cycle of the drum 1 and recovery is effected for all of the charged portion. The reverse toner could be recovered by this method. The toner remaining on the drum could all be recovered by a combination of the methods described in Embodiments 1 and 2. FIG. 8 shows the sequence from the start of copying to the stop of operation, re-operation and the end of standby when Embodiments 1 and 2 are combined together.

(Embodiment 3)

Figure 9:
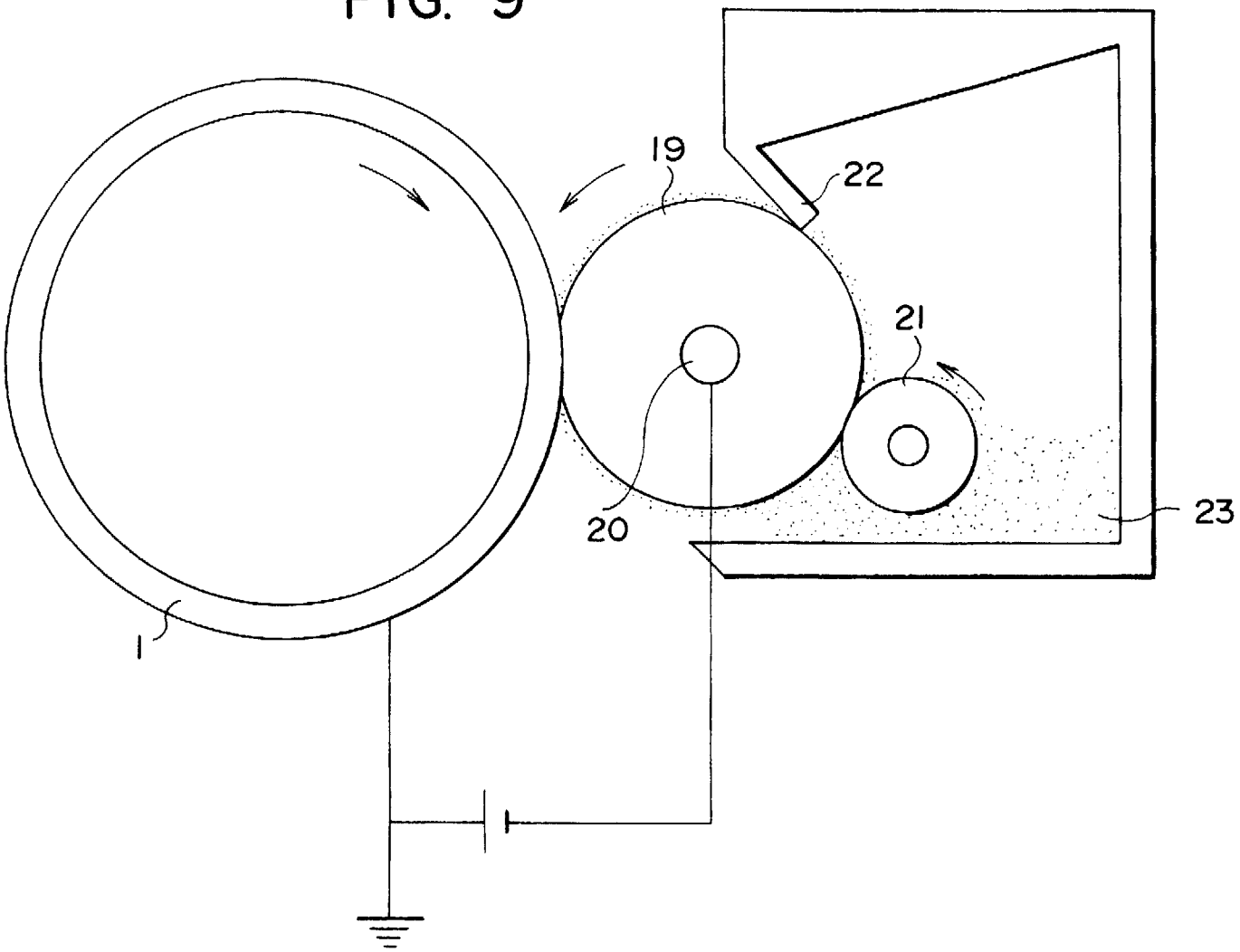
FIG. 9 is a schematic view showing a developing device used in Embodiment 3 of the present invention.

In Embodiments 1 and 2, use has been made of the two-component developing device as shown in FIG. 4, while in this embodiment, use is made of a one-component contact developing device of the construction as shown in FIG. 9. In FIG. 9, the reference numeral 19 designates a developing roller formed of electrically conductive roller formed of electrically conductive rubber on a support shaft 20 of SuS. A metallic blade 22 bears against the developing roller 19 to thereby coat the developing roller with a non-magnetic toner. In FIG. 9, a roller 21 formed of urethane sponge effects the recovery of any residual toner remaining on the developing roller 19 and the supply of a toner 23 to the developing roller 19.

When development is to be effected in the developing device of such a construction, the electrically conductive rubber bears against the photosensitive drum and therefore, development is usually effected by a DC electric field. Assuming, for example, that the charged potential of the drum (the potential of the white ground portion) is −650V, a DC voltage of −300V is applied as a developing bias to the developing sleeve and 350V is required as a fog-removing potential. This is because when one-component contact development is to be effected, the number of toners contacting with the drum becomes greater than that during two-component contact development and this is disadvantageous to fog.

This one-component contact developing method differs only in the above-described developing step from the two-component developing method described in Embodiments 1 and 2, and does not especially differ in the other steps. Accordingly, again in this case, it is possible to effect the cleaning concurrent with development which removes the toner of the non-image portion by a fog-removing electric field.

In the present embodiment, description will be made of a recovering method when in the one-component contact developing method, the operation is stopped as by paper jam during the developing or transferring step and a great deal of toner remains on the drum. The sequence for toner recovery may be just the same as that used in Embodiment 2. However, the recovering bias need be greater than in the case of the two-component developing method and it is preferable that a potential higher by 100 to 350V than the latent image potential by applied to the sleeve.

By such a method, the toner could all be recovered in the one-component contact developing method as well.

While the embodiments of the present invention have been described above, the present invention is not restricted to these embodiments, but any and all modifications are possible within the scope of the technical idea of the invention.

What is claimed is:

1. An image forming apparatus comprising:

an image bearing member;

charging means for uniformly charging said image bearing member;

exposure means for image-exposing said image bearing member charged by said charging means to form an electrostatic image:

developing means for developing the electrostatic image on said image bearing member with a toner and a recovering residual toner on said image bearing member, said developing means including a developing electrode and voltage applying means for applying a bias voltage having AC component to said developing electrode;

feeding means for feeding a transfer medium; and transferring means for transferring the toner image to the transfer medium, wherein upon re-operation after a jam, at least one full rotation of said image bearing member effects the recovery of the toner on said image bearing member with stopping said charging of said charging means while a recovering bias voltage is applied to said developing electrode by said voltage applying means, and wherein a center value of said bias voltage upon developing has a polarity the same as the toner but a center value of said bias voltage upon recovery has a polarity reversed to that of the toner.

2. An image forming apparatus according to claim 1, wherein the recovering bias voltage is a voltage in which only recovering of the toner is effected without effecting developing.

3. An image forming apparatus according to claim 1, wherein after the recovery of the toner with said charging means rendered OFF, said charging means effects charging for stabilizing the potential on said image bearing member.

4. An image forming apparatus according to claim 3, which becomes ready after the termination of the stabilization of the potential.

5. An image forming apparatus according to claim 1, wherein after the termination of the recovery of the toner with the charging by said charging means rendered OFF, the recovery of the toner with the charging rendered ON is effected.

6. An image forming apparatus according to claim 1, wherein the toner is a polymerized toner.

7. An apparatus according to claim 1, wherein after the recovering bias voltage has been applied, said developing means further effects recovery of the toner in such a condition that charging is effected by said charging means.

8. An apparatus according to claim 1, wherein the AV component of the bias voltage applied by said voltage applying means is common to the developing bias voltage and the recovering bias voltage.

* * * * *

UNITED STATES PATENT AND TRADEMARK OFFICE

CERTIFICATE OF CORRECTION

PATENT NO. : 5,781,832

DATED : July 14, 1998

INVENTOR(S) : RYO INOUE, ET AL.

It is certified that error appears in the above-identified patent and that said Letters Patent is hereby corrected as shown below:

COLUMN 1:

Line 6, "08/469/678" should read --08/469,678--.

COLUMN 7:

Line 35, "by" should read --be--.

COLUMN 8:

Line 45, "AV" should read --AC--.

Signed and Sealed this

Twenty-third Day of March, 1999

*Attest:*

Q. TODD DICKINSON

*Attesting Officer*

*Acting Commissioner of Patents and Trademarks*